United States Patent [19]

Allen

[11] 3,954,139

[45] May 4, 1976

[54] SECONDARY RECOVERY BY MISCIBLE VERTICAL DRIVE

[75] Inventor: Joseph C. Allen, Bellaire, Tex.

[73] Assignee: Texaco Inc., New York, N.Y.

[22] Filed: Sept. 30, 1971

[21] Appl. No.: 185,337

[52] U.S. Cl. ..... 166/272

[51] Int. Cl.[2] ..... E21B 43/24

[58] Field of Search ..... 166/272, 303

[56] References Cited

UNITED STATES PATENTS

| | | | |
|---|---|---|---|
| 3,135,326 | 5/1964 | Santee | 166/272 |
| 3,351,132 | 11/1967 | Dougan et al. | 166/272 |
| 3,386,508 | 5/1968 | Bielstein et al. | 166/272 |
| 3,412,794 | 11/1968 | Craighead | 166/303 |
| 3,439,743 | 4/1969 | Wyllie | 166/272 |
| 3,524,504 | 8/1970 | Allen | 166/303 |
| 3,608,638 | 9/1971 | Terwilliger | 166/272 |

*Primary Examiner*—Frank L. Abbott
*Assistant Examiner*—Jack E. Ebel
*Attorney, Agent, or Firm*—T. H. Whaley; C. G. Ries; Kenneth R. Priem

[57] ABSTRACT

A method for recovering oil by injecting a miscible fluid to drive the oil vertically downward to the producing wells wherein the injected miscible fluid is heated so that it has a temperature equal to or greater than normal reservoir fluid temperature.

4 Claims, 2 Drawing Figures

SECONDARY RECOVERY BY MISCIBLE VERTICAL DRIVE

BACKGROUND OF THE INVENTION

1. Field of the Invention

The invention pertains to the field of miscible flooding for the secondary recovery of oil from subterranean reservoirs.

2. Brief Description of the Prior Art

Oil recovery by flooding with an extraneous fluid is a well known technique. One type of flooding utilizes fluids which are miscible with the oil in the reservoir. The fluids displace the oil in the reservoir toward the production wells. Miscible fluids also clean the reservoir oil from the pores of the sand and are, therefore, a more efficient flooding medium than water which is normally used.

If the miscible fluids are less dense than the reservoir fluids the efficiency of these miscible fluids is further enhanced by injecting them higher in the reservoir than the level where oil production is taken. This results in a vertical drive in the reservoir which takes advantage of natural density gradients and places the lighter fluid on top of the heaver fluid. Most miscible fluids are light hydrocarbons, solvents or gases for example, which are lighter than reservoir oil; therefore, a vertical drive is the most effective means of flooding the oil column with these miscible fluids.

The success of vertical flooding is dependent upon maintaining a well defined, discrete horizontal interface between the miscible fluid and the oil to be displaced. Mixing of the oil and the miscible fluid is detrimental to the flooding operation since the miscible fluid loses its ability to clean the oil in the reservoir as it becomes increasingly saturated with oil.

In every thick or steeply dipping bed a geothermal gradient exists with the temperature increasing with depth. This is called the geothermal gradient. Where there is adequate vertical permeability the geothermal gradient will cause convection mixing of the fluids at different levels in the reservoir. Thus, the hotter fluids low in the reservoir will tend to mix with the cooler fluids high in the reservoir as the reservoir attampts to gain equilibrium. Normally the reservoir temperature is much higher than the ambient temperature on the surface; therefore, if a miscible fluid at ambient surface temperature is injected into the top of a much hotter reservoir convection currents caused by the temperature and possible density differences will cause the hot oil to rise in the formation and mix with the cooler miscible fluid. The miscible fluid will thus be absorbed into the oil column and the miscible drive mechanism will be lost.

It is, therefore, an object of this invention to provide a method whereby a vertical miscible flooding operation may be carried on with a minimum of mixing of the oil and the reservoir fluid.

This may be accomplished by heating the injected fluid to a temperature higher than the reservoir temperature so that when the injected miscible fluid reaches reservoir depth it will be at a temperature higher than or equal to the reservoir temperature. When this is done the convection currents which normally rise from a hot fluid into an overlying cold fluid will no longer be able to rise since the hot miscible fluid is now above the cooler oil in the reservoir. By so minimizing the convection currents mixing will be reduced and the miscible fluid will remain intact as it drives the oil downward, This may be referred to as inverting the geothermal gradient.

SUMMARY OF THE INVENTION

A method for producing oil from an oil reservoir penetrated by at least one injection well and at least one production well and the production well is open to the oil stratum at a greater depth from the vertical than the injection well wherein a slug of fluid miscible with and less dense than the reservoir oil is injected into the reservoir through the injection wells and oil is produced through the production wells the improvement which comprises heating the miscible fluid to be injected to a temperature such that when the fluid reaches reservoir depth it will be at a temperature equal to or above the normal reservoir temperature.

DESCRIPTION OF THE PREFERRED EMBODIMENTS

The types of reservoirs in which the vertical flooding techniques are usually carried out are either thick reservoirs or steeply dipping reservoirs where the vertical thickness is fairly large.

The miscible fluid to be injected into the top of this reservoir may be any fluid which is partially or totally miscible with the reservoir oil and less dense than the reservoir oil. For example, propane, butane and naphtha or mixtures of these are suitable.

The temperature of the fluid must be such that when the fluid reaches the reservoir its temperature is equal to or greater than the temperature of the reservoir fluids. Therefore, it follows that since heat will be lost as the fluid is being injected, the temperature of the fluid at the surface will always be required to be greater than that needed at reservoir depth. How much greater depends on the depth of the reservoir and other factors that will cause the fluid to lose thermal energy as it is being injected. It is within the knowledge of one skilled in the art to determine the proper surface temperature of the miscible fluid to achieve a desired temperature at reservoir depth.

When applied to an actual production situation the slug of miscible fluid must be followed by gas or other fluid miscible with the slug. This is necessary because most miscible fluids are too expensive to be used except as a slug. It is apparent that to minimize the convective currents on the trailing edge of the slug or miscible fluid, it will be necessary to have the following gas at a temperature equal to or greater than the slug or miscible fluid. This will maintain the integrity of the slug at the trailing edge.

Figure 1:
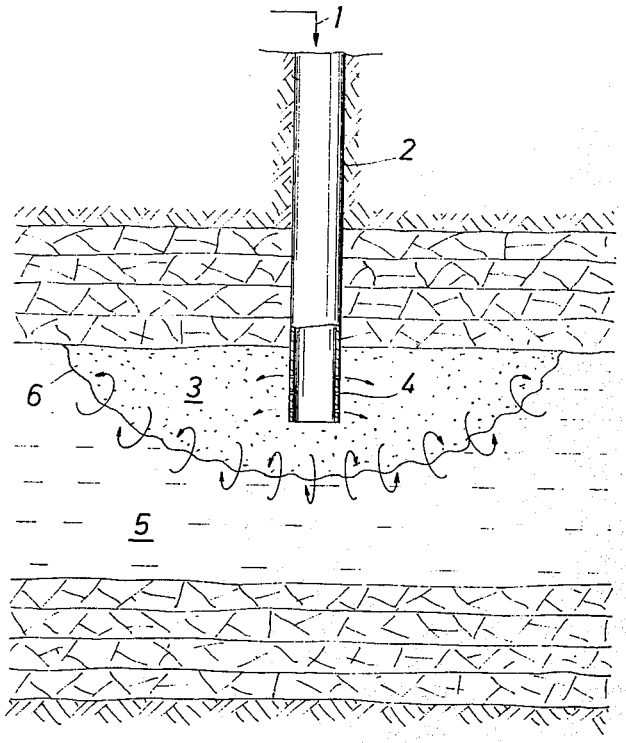
FIG. 1 illustrates cold miscible fluid driving oil to production wells.

FIG. 1 illustrates convective mixing of reservoir oil and a slug of miscible fluid colder than the reservoir oil. The cold fluid 1 is pumped into a well 2 which penetrates and is in communication with the oil reservoir 5. The cold fluid is pumped into the formation through openings 4, in the well. A slug of miscible fluid 3 is built up at the top of the oil reservoir. However, at the interface 6 between the miscible fluid and the oil, convective currents, as depicted by the arrows, mix the miscible fluid and the oil. If not checked these convective cuurents will destroy the interface between the miscible fluid and the oil and the miscible slug will be absorbed into the oil and lose its displacing properties.

Figure 2:
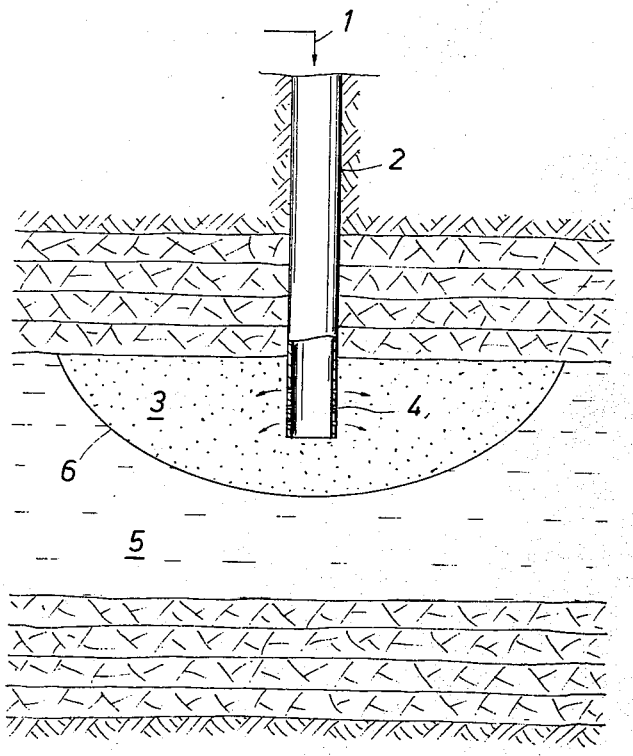
FIG. 2 is the process of my invention where a hot miscible fluid is used.

FIG. 2 illustrates the process of my invention where the corresponding elements are numbered as in FIG. 1 except that there the miscible fluid 1 is at a temperature equal to or greater than the reservoir temperature when it reaches the reservoir; so that the convective currents in FIG. 1 are absent and the miscible fluid will not be prone to mix with the oil.

My invention may be illustrated by the following example.

EXAMPLE 1

This example will demonstrate the effect of temperature gradients in the reservoir on the injection of a typical miscible slug followed by natural gas to displace the slug through the reservoir.

Assumed Fluid Properties

| | Gas | Solvent Slug | Reservoir Liquid |
|---|---|---|---|
| Density at 2145 psia - 167°F ($lbs/ft^3$) | 8.67 | 23.56 | 43.00 |
| Molecular Weight | 21.9 | 37.3 | 105.6 |

The following is a table of enthalpy for methane through butane.

| | Molecular Weight | Enthalpy (BTU/lb) 170°F | 70°F | ΔH |
|---|---|---|---|---|
| Methane | 16 | 358 | 280 | 78 |
| Ethane | 30 | 248 | 185 | 63 |
| Propane | 44 | 225 | 150 | 75 |
| Butane | 52 | 205 | 140 | 65 |
| | | | Average | 70 |

Both the slug and gas usually have average molecular weights in the range between methane and propane. The change in heat content does not vary widely between the above hydrocarbons. AΔH of 70 BTU/lb was used in the following calculations of heat removed from the formation by the injection of fluids at 70°F. Assume a hypothetical reservoir containing about 400 × $10^6$ bbls. of stock tank oil and a solvent slug of 30 × $10^6$ reservoir barrels will be injected followed by 300 × $10^9$ SCF of gas. The solvent is injected into six wells and the gas into seven wells.

Solvent Slug

Injection Volume = 30 × $10^6$ reservoir barrels $$\text{Total Heat} = \frac{\text{bbl}\ (30 \times 10^6)\ \ \text{ft}^3/\text{bbl}\ (5.61)\ \ \text{lbs/ft}^3\ (2.36 \times 10)\ \ \text{H BTU/lb}\ (7 \times 10)}{} =$$

Solvent Slug-continued

279 × $10^9$ BTU

Gas

Injection Volume = 300 × $10^9$ SCF $$\text{Total Heat} = \frac{\text{SCF}\ (3.0 \times 10^{11})\ \ \text{lbs/mol}\ (2.19 \times 10)\ \ \text{BTU/lb}\ (7 \times 10)}{3.8 \times 10^2)\ \text{ft}^3/\text{lb mol.}} = 1{,}210 \times 10^9 \text{ BTU}$$

Heat Removed from Formation

| Fluid | Heat ($10^9$ BTU) Total | No. wells | Per Well |
|---|---|---|---|
| Slug | 279 | 6 | 46.5 |
| Residue Gas | 1,210 | 7 | 173.0 |
| Slug Plus Residue Gas | 1,489 | 7 | 212.5 |

In order to obtain an estimate of the volume of the reservoir that would be affected by the injection of colder fluids, the following calculations were made. It was assumed that (1) the overall specific heat of the formation was 0.2 BTU/lb/°F, (2) the overall density of the formation was 2.93 g/cc or 183 $lbs/ft^3$, and (3) the volume of the formation that is affected is cooled from 170° to 70°F, the remainder of the formation remaining at 170°F.

Volumes of Formation Cooled per Well by Slug $$\text{Volume} = \frac{\text{BTU}\ (4.65 \times 10^{10})}{(10^2)\ \text{T(°F)}\ \ (2 \times 10^{-1})\ \text{BTU/lb/°F}\ \ (1.83 \times 10^2)\ \text{lbs/ft}^3} = 12.6 \times 10^6\ \text{ft}^3$$

| | Volumes per Well | Sphere Diameter (ft) (Each Well) |
|---|---|---|
| Slug | 12.6 × $10^6$ $ft^3$ | 286 |
| Gas | 47.1 × $10^6$ $ft^3$ | 447 |
| Slug Plus Gas | 58.0 × $10^6$ $ft^3$ | 480 |

Sphere diameters were calculated for the above volumes which would be for the hypothetical case of uniform flow of injected fluids into the formation in all directions. These diameters are listed above.

The radius from each well (6) that would be affected by the slug only, having a uniform thickness of 30 feet, based on the above assumptions, is 365 feet or a diameter of 730 feet. This establishes a high temperature gradient across 440,000 square feet of contact between the slug and the reservoir oil, resulting in convective mixing of the two fluids and loss of slug identity.

Injection of the fluids heated to at least reservoir temperature would remove this deleterious effect.

I claim:

1. In a method for producing oil from an oil reservoir penetrated by at least one injection well and at least one production well and the production well is open to the oil stratum at a greater depth from the vertical than the injection well wherein a slug of fluid miscible with and less dense than the reservoir oil is injected into the reservoir through the injection wells to drive the oil downward and oil is produced through the production wells the improvement which comprises heating the miscible fluid to be injected to a temperature which is above the reservoir temperature so that the injected miscible fluid will have a temperature about equal to the reservoir temperature when the miscible fluid reaches the reservoir.

2. A method as in claim 1 wherein the injected miscible fluid is propane.

3. A method as in claim 1 wherein the injected miscible fluid is butane.

4. A method as in claim 1 wherein the injected miscible fluid is a mixture of propane and butane.

* * * * *